US011519055B2

(12) United States Patent
Laws et al.

(10) Patent No.: US 11,519,055 B2
(45) Date of Patent: Dec. 6, 2022

(54) METAL ALLOYS INCLUDING COPPER

(71) Applicant: Advanced Alloy Holdings PTY LTD, Freshwater (AU)

(72) Inventors: Kevin Laws, Sydney (AU); Michael Ferry, Sydney (AU); Patrick Conway, Sydney (AU); Warren McKenzie, Sydney (AU); Lori Bassman, Claremont, CA (US); Cody Crosby, Los Altos, CA (US); Aarthi Sridhar, Durham, NC (US)

(73) Assignee: ADVANCED ALLOY HOLDINGS PTY LTD, Freshwater (AU)

( * ) Notice: Subject to any disclaimer, the term of this patent is extended or adjusted under 35 U.S.C. 154(b) by 0 days.

(21) Appl. No.: 16/943,824

(22) Filed: Jul. 30, 2020

(65) Prior Publication Data

US 2020/0362437 A1 Nov. 19, 2020

Related U.S. Application Data

(63) Continuation of application No. 15/522,099, filed as application No. PCT/AU2015/050670 on Oct. 27, 2015, now abandoned.

(30) Foreign Application Priority Data

Oct. 28, 2014 (AU) ..... 2014904315

(51) Int. Cl.

| | |
|---|---|
| ***C22C 9/06*** | (2006.01) |
| ***C22C 30/06*** | (2006.01) |
| ***C22C 45/00*** | (2006.01) |
| ***C22C 30/02*** | (2006.01) |
| ***C22C 30/04*** | (2006.01) |
| ***C22F 1/00*** | (2006.01) |
| ***C22F 1/16*** | (2006.01) |

(52) U.S. Cl.

CPC ..... *C22C 9/06* (2013.01); *C22C 30/02* (2013.01); *C22C 30/04* (2013.01); *C22C 30/06* (2013.01); *C22C 45/00* (2013.01); *C22F 1/00* (2013.01); *C22F 1/16* (2013.01); *C22C 2202/02* (2013.01)

(58) Field of Classification Search

CPC ..... C22C 9/06; C22C 30/04; C22C 30/02; C22C 45/00; C22C 30/06; C22C 2202/02; C22F 1/16; C22F 1/00

See application file for complete search history.

(56) References Cited

U.S. PATENT DOCUMENTS

| | | | | |
|---|---|---|---|---|
| 3,725,052 | A * | 4/1973 | Kikuchi | C22C 22/00 420/434 |
| 6,059,901 | A | 5/2000 | Sahu | |
| 6,074,604 | A | 6/2000 | Saito et al. | |
| 8,147,751 | B2 | 4/2012 | Oishi | |
| 2002/0159914 | A1* | 10/2002 | Yeh | C22C 1/02 420/580 |
| 2014/0294665 | A1* | 10/2014 | Torre | C22C 30/06 420/582 |
| 2017/0349975 | A1* | 12/2017 | Laws | C22C 45/00 |

FOREIGN PATENT DOCUMENTS

| | | | | |
|---|---|---|---|---|
| DE | 2051566 | A1 * | 4/1972 | C22C 9/06 |
| DE | 102009021336 | A1 | 11/2010 | |
| SU | 555160 | A1 | 4/1977 | |

OTHER PUBLICATIONS

Wakasa et al. , "Corrosive properties in experimental Ni—Cu—Mn-based alloy systems for dental purposes," J. Mats. Sci. in Med. 1 (1990) pp. 171-176. (Year: 1990).*

DE 2051566A1, Ward et al. (machine translation) (Year: 1972).*

Wakasa et al. "Dental application of the 30Ni—30Cu—40Mn ternary alloy system," J Materials Sci: Materials in Medicine 1:44-48, 1990b.

Florea et al. "Microstructure and mechanical tests of AlNiMnZnCu high entropy alloys," Adv Mat Res 1036:95-100, 2014.

EP Search Report for EP3212815 dated Jul. 27, 2018.

* cited by examiner

*Primary Examiner* — John A Hevey

(74) *Attorney, Agent, or Firm* — Norton Rose Fulbright US LLP

(57) ABSTRACT

The present invention relates to matter alloys including copper.

6 Claims, No Drawings

METAL ALLOYS INCLUDING COPPER

CROSS-REFERENCE TO RELATED APPLICATION

This application is a continuation of U.S. patent application Ser. No. 15/522,099 filed Apr. 26, 2017, and entitled "METAL ALLOYS INCLUDING COPPER," which is a U.S. national stage of International Application Serial No. PCT/AU2015/050670 filed Oct. 27, 2015, which claims priority to Australian Patent Application No. 2014904315 filed Oct. 28, 2014, the benefit of which is claimed and the disclosure of which is incorporated herein by reference in its entirety.

TECHNICAL FIELD

Metal alloys including copper are disclosed. The alloys have a similar variety of applications to brass and bronze alloys.

BACKGROUND ART

The current role of typical brasses and bronzes in the world today is extensive. Some examples include house keys (sometimes chrome plated), the key-ring they are on, the domestic door hinges, door knobs and all their internal lock mechanisms, bathroom fixtures (which are typically chromed or polished brass), clothes and bags zippers, electronics connection hardware, gears in gear motors, automotive and personal electronic device bezels, badges, military munitions and highly corrosion resistant marine fixtures. Brasses are even the largest constituent of world coin currencies.

All brasses and bronzes can be chrome or nickel plated with ease for further decorative or corrosion resistant applications.

Typical brasses consist predominantly of copper and zinc, with practical alloy compositions being in the range of copper 60 to 80 weight % and zinc 20-40 weight % with minor additions of lead and aluminium possible (from 1-5 weight %).

Typical bronzes are generally much higher in copper content and consist of 90-95 weight % copper, with small additions of tin, aluminium and sometimes silver.

It would be advantageous to reduce the cost of components formed of copper-based alloys in the existing range of applications. Alternatively, it would be advantageous to extend the working life of copper-based alloys in the existing applications or to make copper-based alloys suitable for additional applications by improving the mechanical properties of copper-based alloys or by improving corrosion resistance or by reducing the cost to manufacture copper-based alloys with similar or improved mechanical or corrosion resistance properties.

The above references to the background art here and throughout the specification, including references to bronze and brass alloys being "typical", do not constitute an admission that the art forms a part of the common general knowledge of a person of ordinary skill in the art. The above references are also not intended to limit the application of the alloys.

SUMMARY OF THE DISCLOSURE

The applicants have found that substituting a large amount of copper in typical bronzes and brasses with manganese and nickel produces alloys with improved mechanical properties. Additionally, the amounts of copper, nickel, manganese, zinc, aluminium and tin can be adjusted so that the properties of the alloy can be tailored to specific applications. Collectively, the copper-based alloys in accordance with the finding of the applicants are termed 'high entropy brasses' (HEBs) on account of the lower amount of copper and higher amounts of nickel and manganese compared with typical brasses and bronzes, together with other alloying elements of tin, zinc, aluminium and other elements included in the alloys.

More specifically, there is provided in a first aspect an alloy comprising, consisting of, or consisting essentially of:

| | |
|---|---|
| Copper | 10 to 50 at. % |
| Nickel | 5 to 50 at. % |
| Manganese | 5 to 50 at. % |
| Zinc | 0 to 50 at. % |
| Aluminium | 0 to 40 at. % |
| Tin | 0 to 40 at. % |
| Chromium | 0 to 2 at. % |
| Iron | 0 to 2 at. % |
| Cobalt | 0 to 2 at. % |
| Lead | 0 to 2 at. % |
| Silicon | 0 to 25 at. % |

and wherein the alloy has entropy of mixing ($\Delta S_{mix}$) of at least 1.1 R when calculated according to:

$$\Delta S_{mix} = -R\sum_{i=1}^{n}(c_i \ln c_i) \quad \text{(Equation 1)}$$

where c is the molar percentage of the ith component and R being the gas constant.

The alloy may contain incidental impurities.

Alloying with copper, nickel, manganese, zinc, aluminium and tin allows for the formation of single-phase and/or duplex phase microstructures (either face-centred cubic structure, face centred cubic and body centred cubic or body centred cubic) whereby an alloy's strength, ductility and corrosion resistance can be controlled. Including these elements, and in particular copper, nickel and manganese, in amounts that are more even that in typical brasses and bronzes increases the entropy of the alloy, leading to greater microstructural stability and contributing to the enhancement of mechanical, chemical and physical properties. Typically these new alloys have one or more of the following advantages:

exhibit superior mechanical performance and corrosion resistance compared to typical bronze and brass alloys have lower material cost compared to typical bronze and brass alloys are lighter than typical bronze and brass alloys can be processed in similar ways to typical bronze and brass alloys can be chrome or nickel plated—if necessary The HEBs may include amounts of iron, cobalt, chromium, lead and silicon in amounts selected to have a specific effect on the properties of the alloy. These alloying elements are, therefore, another means of tailoring the HEBs to specific applications.

For example, alloys according to the first aspect may include any one or more of:

| | |
|---|---|
| Aluminium | 1 to 30 at. % |
| Tin | 1 to 30 at. % |
| Zinc | 1 to 50 at. % |
| Silicon | 1 to 25 at. % |

In one embodiment, alloys according to the first aspect may include one of:

| | |
|---|---|
| Aluminium | 1 to 30 at. % |
| Tin | 1 to 30 at. % |
| Zinc | 1 to 50 at. % or |
| Silicon | 1 to 25 at. % |

There is also provided in a second aspect an alloy comprising, consisting of, or consisting essentially of copper and three or more alloying elements selected from nickel, manganese, zinc, aluminium and tin and wherein the alloy has entropy of mixing ($\Delta S_{mix}$) of at least 1.1 R when calculated according to Equation 1.

The alloy may contain incidental impurities.

The alloy of the second aspect may include one or more alloying elements selected from the group comprising or consisting of:

| | |
|---|---|
| Chromium | 0 to 2 at. % |
| Iron | 0 to 2 at. % |
| Cobalt | 0 to 2 at. % |
| Lead | 0 to 2 at. % |
| Silicon | 0 to 25 at. % |

In an embodiment of the second aspect there is provided an alloy comprising, consisting of, or consisting essentially of copper and three alloying elements selected from nickel, manganese, zinc, aluminium and tin and wherein the alloy has entropy of mixing ($\Delta S_{mix}$) of at least 1.1 R when calculated according to Equation 1.

In another embodiment of the second aspect there is provided an alloy comprising, consisting of, or consisting essentially of:

(i) copper and three alloying elements selected from nickel, manganese, zinc, aluminium and tin, and (ii) chromium 0 to 2 at. %, iron 0 to 2 at. %, cobalt 0 to 2 at. % and lead 0 to 2 at. %, and wherein the alloy has entropy of mixing ($\Delta S_{mix}$) of at least 1.1 R when calculated according to Equation 1.

In a further embodiment of the second aspect there is provided an alloy comprising, consisting of, or consisting essentially of:

(i) copper, nickel and manganese, (ii) one alloying element selected from zinc, aluminium and tin, and (iii) chromium 0 to 2 at. %, iron 0 to 2 at. %, cobalt 0 to 2 at. % and lead 0 to 2 at. %, and wherein the alloy has entropy of mixing ($\Delta S_{mix}$) of at least 1.1 R when calculated according to Equation 1.

In still a further embodiment of the second aspect there is provided an alloy comprising, consisting of, or consisting essentially of:

(i) copper, nickel and manganese, (ii) one alloying element selected from zinc, aluminium and tin, and wherein the alloy has entropy of mixing ($\Delta S_{mix}$) of at least 1.1 R when calculated according to Equation 1.

In yet another embodiment of the second aspect there is provided an alloy comprising:

(i) copper, nickel and manganese, (ii) one or more alloying elements selected from zinc, aluminium and tin, and wherein the alloy has entropy of mixing ($\Delta S_{mix}$) of at least 1.1 R when calculated according to Equation 1.

In another embodiment of the second aspect there is provided an alloy comprising, consisting of, or consisting essentially of copper and three alloying elements selected from silicon, nickel, manganese, zinc, aluminium and tin and wherein the alloy has entropy of mixing ($\Delta S_{mix}$) of at least 1.1 R when calculated according to Equation 1.

In yet another embodiment of the second aspect there is provided an alloy comprising, consisting of, or consisting essentially of:

(i) copper and three alloying elements selected from silicon, nickel, manganese, zinc, aluminium and tin, and (ii) chromium 0 to 2 at. %, iron 0 to 2 at. %, cobalt 0 to 2 at. % and lead 0 to 2 at. %, and wherein the alloy has entropy of mixing ($\Delta S_{mix}$) of at least 1.1 R when calculated according to Equation 1.

In yet another embodiment of the second aspect there is provided an alloy comprising, consisting of, or consisting essentially of:

(i) copper, nickel and manganese, (ii) one alloying element selected from silicon, zinc, aluminium and tin, and (iii) chromium 0 to 2 at. %, iron 0 to 2 at. %, cobalt 0 to 2 at. % and lead 0 to 2 at. %, and wherein the alloy has entropy of mixing ($\Delta S_{mix}$) of at least 1.1 R when calculated according to Equation 1.

In still a further embodiment of the second aspect there is provided an alloy comprising, consisting of, or consisting essentially of:

(i) copper, nickel and manganese, (ii) one alloying element selected from silicon, zinc, aluminium and tin, and wherein the alloy has entropy of mixing ($\Delta S_{mix}$) of at least 1.1 R when calculated according to Equation 1.

There is provided in a third aspect an alloy comprising, consisting of, or consisting essentially of:

| | |
|---|---|
| Copper | 10 to 50 at. % |
| Nickel | 5 to 50 at. % |
| Manganese | 5 to 50 at. % |
| Chromium | 0 to 2 at. % |
| Iron | 0 to 2 at. % |
| Cobalt | 0 to 2 at. % |
| Lead | 0 to 2 at. %, and one of: |
| Zinc | 1 to 50 at. % |
| Aluminium | 1 to 40 at. % |
| Tin | 1 to 40 at. % or |
| Silicon | 1 to 25 at. % |

and wherein the alloy has entropy of mixing ($\Delta S_{mix}$) of at least 1.1 R when calculated according to Equation 1.

The alloy may contain incidental impurities.

In one embodiment alloys according to the third aspect may comprise, consist of, or consist essentially of:

| | |
|---|---|
| Copper | 10 to 50 at. % |
| Nickel | 5 to 50 at. % |
| Manganese | 5 to 50 at. % |

-continued

| | |
|---|---|
| Chromium | 0 to 2 at. % |
| Iron | 0 to 2 at. % |
| Cobalt | 0 to 2 at. % |
| Lead | 0 to 2 at. %, and one of: |
| Zinc | 20 to 35 at. % |
| Aluminium | 5 to 40 at. % |
| Tin | 5 to 25 at. % or |
| Silicon | 2.5 to 15 at. % |

and wherein the alloy has entropy of mixing ($\Delta S_{mix}$) of at least 1.1 R when calculated according to Equation 1.

In another embodiment alloys according to the third aspect may comprise, consist of, or consist essentially of:

| | |
|---|---|
| Copper | 10 to 50 at. % |
| Nickel | 5 to 50 at. % |
| Manganese | 5 to 50 at. % and one of: |
| Zinc | 1 to 50 at. % |
| Aluminium | 1 to 40 at. % |
| Tin | 1 to 40 at. % or |
| Silicon | 1 to 25 at. % |

and wherein the alloy has entropy of mixing ($\Delta S_{mix}$) of at least 1.1 R when calculated according to Equation 1.

In yet another embodiment alloys according to the third aspect may comprise, consist of, or consist essentially of:

| | |
|---|---|
| Copper | 10 to 50 at. % |
| Nickel | 5 to 50 at. % |
| Manganese | 5 to 50 at. %, and one of: |
| Zinc | 20 to 35 at. % |
| Aluminium | 5 to 40 at. % |
| Tin | 5 to 25 at. % or |
| Silicon | 2.5 to 15 at. % |

and wherein the alloy has entropy of mixing ($\Delta S_{mix}$) of at least 1.1 R when calculated according to Equation 1.

The alloy of the first, second or third aspect may have entropy in the range of 1.1 R to 2.5 R. Alternatively, the alloy may have entropy in the range of 1.3 R to 2.0 R. By way of comparison, the entropy of a typical brass or bronze calculated using Equation 1 will be no greater than approximately 0.82 R.

Copper, nickel and manganese may be present in substantially equal atomic percentages in the alloy of the first, second or third aspect.

The alloy of the first, second or third aspect may consist of, or consist essentially of [Cu+Mn+Ni] 50 to 95 at. % with the balance being Al.

The alloy of the first, second or third aspect may consist of, or consist essentially of [Cu+Mn+Ni] 60 to 95 at. % with the balance being Al.

The alloy of the first, second or third aspect may consist of, or consist essentially of Cu, Mn, Ni and Al and have an as-cast hardness (Hv) in the range of 154 to 398.

The alloy of the first, second or third aspect may consist of, or consist essentially of [Cu+Mn+Ni] 75 to 95 at. % with the balance being Si.

The alloy of the first, second or third aspect may consist of, or consist essentially of [Cu+Mn+Ni] 85 to 97.5 at. % with the balance being Si.

The alloy of the first, second or third aspect may consist of, or consist essentially of Cu, Mn, Ni and Si and have an as-cast hardness (Hv) in the range of 187 to 370.

The alloy of the first, second or third aspect may consist of, or consist essentially of [Cu+Mn+Ni] 60 to 95 at. % with the balance being Sn.

The alloy of the first, second or third aspect may consist of, or consist essentially of [Cu+Mn+Ni] 75 to 95 at. % with the balance being Sn.

The alloy of the first, second or third aspect may consist of, or consist essentially of Cu, Mn, Ni and Sn and have an as-cast hardness (Hv) in the range of 198 to 487.

The alloy of the first, second or third aspect may consist of, or consist essentially of [Cu+Mn+Ni] 50 to 95 at. % with the balance being Zn.

The alloy of the first, second or third aspect may consist of, or consist essentially of [Cu+Mn+Ni] 65 to 80 at. % with the balance being Zn.

The alloy of the first, second or third aspect may consist of, or consist essentially of Cu, Mn, Ni and Zn and have an as-cast hardness (Hv) in the range of 102 to 253.

The alloy of the first, second or third aspect may be a quinary alloy consisting of, or consisting essentially of [Cu+Mn+Ni] 50 to 95 at. % with the balance being Al and Zn.

The alloy of the first, second or third aspect may consist of, or consist essentially of Cu, Mn, Ni, Al and Zn and have an as-cast hardness (Hv) in the range of 200 to 303.

An alternative alloy of the first, second or third aspect may be a quinary alloy consisting of, or consisting essentially of [Cu+Mn+Ni] 75 to 90 at. % with the balance being Al and Sn.

An alternative alloy of the first, second or third aspect may be a quinary alloy consisting of, or consisting essentially of [Cu+Mn+Ni] 50 to <100 at. % with the balance being Sn and Zn.

A further alternative alloy of the first, second or third aspect may be an alloy consisting of, or consisting essentially of Cu, Mn, Ni, Al, Zn, Sn and comprise a single phase or duplex phase brass.

The alloy of the first, second or third aspect may have compressive yield strength in the range of 140 to 760 MPa. Alternatively, the compressive yield strength may be in the range of 290 to 760 MPa. In a further alternative, the compressive yield strength may be in the range of 420 to 760 MPa.

The alloy of the first, second or third aspect may have strain at compressive failure of <2% to 80%. In an alternative, the strain at compressive failure may be <2% to 60%. In a further alternative, the strain at compressive failure may be <2% to 40%. In yet another alternative, the strain at compressive failure may be <2% to <5%.

In a further aspect, there is a provided a casting of an alloy according to the first, second or third aspect. The casting may be heat treated.

The term "alloy" as used throughout this specification includes a reference to castings. The term also includes within its scope other metal products having a composition defined according to the first, second or third aspects defined above.

Those skilled in the art will appreciate that the alloys disclosed herein may contain incidental unavoidable impurities.

DESCRIPTION OF EMBODIMENTS

Test work carried out by the applicants has identified HEBs as having desirable properties in comparison to the properties of typical brasses and bronzes. In particular, the HEBs are based on the realisation by the applicants that the desirable properties are obtained by replacing a significant portion of copper in typical brasses and bronzes with manganese and nickel to produce alloys with considerably higher entropy of mixing ($\Delta S_{mix}$ according to Equation 1 above) compared with the entropy of mixing for typical brasses and bronzes.

A range of typical brass compositions and their associated mechanical properties are listed in Table 1. Amongst them, the copper-content ranges from 61 at. % to 85 at. % and the tensile yield strength ranges from 186 MPa to 315 MPa. It will be appreciated, however, that tensile yield strength does not vary linearly with copper-content. These alloys all have entropy of mixing that is no greater than approximately 0.82 R when calculated according to Equation 1.

| Alloy Composition at. % | Crystal Structure | Hardness (Vickers) | Yield $\sigma_T$ (MPa) | Elongation (Tensile Strain) |
|---|---|---|---|---|
| $Cu_{76}Zn_{19.5}Al_{4.5}$ (Al-Brass) | fcc | 95 | 186 | 55% |
| $Cu_{61}Zn_{38.5}Sn_{0.5}$ (Naval Brass) | fcc + bcc | 146 | 315 | 27% |
| $Cu_{70}Zn_{30}$ (C26000) | fcc | 100 | 275 | 43% |
| $Cu_{85}Zn_{15}$ (C23000) | fcc | 100 | 270 | 25% |
| $Cu_{65}Zn_{32.5}Pb_{2.5}$ (C35300) | fcc | 138 | 310 | 25% |

$$\Delta S_{mix} = -R\sum_{i=1}^{n}(c_i \ln c_i)$$

(Equation 1)

The applicants have found that alloys with comparable or improved mechanical, chemical and physical properties can be obtained by replacing a significant amount of copper in typical brasses and bronzes with manganese and nickel and other alloying elements to produce alloys that have entropy of mixing according to Equation 1 that is at least 1.1 R.

The alloys may have Cu 10 to 50 at. %, Ni 5 to 50 at. % and Mn 5 to 50 at. %. The alloys optionally include varying amounts of Zn (0 to 50 at. %), Sn (0 to 40 at. %), Fe (0 to 2 at. %), Cr (0 to 2 at. %), Pb (0 to 2 at. %), Co (0 to 2 at. %) and Si (0 to 25 at. %) depending on the desired properties of the alloy. It will be appreciated, however, that the alloys may include other alloying elements in amounts alongside Cu, Mn and Ni so that the alloy has entropy of mixing according to Equation 1 that is at least 1.1 R.

Examples of alloys identified by the applicant were prepared and tested to determine their properties. The examples are outlined below. All examples were prepared by the following method.

A ternary master alloy of substantially equi-atomic Cu, Mn and Ni was prepared from high purity elements Cu (99.95 wt. %), Ni (99.95 wt. %) and Mn (99.8 wt. %) using a Buhler MAM1 arc melter in a Ti-gettered argon (99.999 vol. %) atmosphere. Ingots of the master alloy were turned and melted five times to ensure a homogeneous master alloy was achieved. Care was also taken to ensure a sufficiently low melt superheat as to avoid the evaporation of Mn.

Quaternary and quinary alloy ingots containing Zn were alloyed using an induction furnace by combining the master alloy with pure Zn (99.99 wt. %) in a boron nitride-coated graphite crucible. These alloys were heated in a step-wise fashion with sufficient holding times at 700° C., 900° C. and 1050° C. to enable the dissolving of the master alloy in Zn in order to minimise Zn evaporation, yet produce a homogeneous alloy melt. Once a steady Zn evaporation rate was determined for this alloying process, excess Zn was added to these alloys to compensate for this loss. Although the Zn loss through evaporation was less than 20%, it is expected that industrial-scale production according to current production processes for alloys including Zn would result in around 20% loss of Zn during manufacturing.

Quaternary alloys containing Al or Sn were produced by adding the balance of Al (99.99 wt. %) or Sn (99.95 wt. %) to the master alloy, arc melting and vacuum casting into a copper mould to produce 3 mm diameter rods.

Once solidified, alloy samples were removed from the mould and allowed to cool to room temperature. They were then were heat treated in an elevator furnace at 850° C. for 18 hours under a circulating argon atmosphere and then quenched in water.

$[Cu, Ni, Mn]_{100-x}Al_x$ Alloy System

Table 2 below lists six samples of Cu, Ni, Mn, Al alloys and some key properties.

TABLE 2

| Alloy Composition | Crystal Structure: As-Cast | Crystal Structure: Heat treated | Hardness (Vickers): As-Cast | Hardness (Vickers): Heat Treated | Yield σC (MPa) | Comp Strain | Magnetic |
|---|---|---|---|---|---|---|---|
| $[CuNiMn]_{95}Al_5$ | fcc | $fcc_1$ + $fcc_2$ | 166 ± 12 | 173 ± 2.5 | 290 | 60% | No |
| $[CuNiMn]_{90}Al_{10}$ | $fcc_1$ + $fcc_2$ | $fcc_1$ + $fcc_2$ | 241 ± 2.5 | 220 ± 4.3 | 480 | 40% | No |
| $[CuNiMn]_{80}Al_{20}$ | $fcc_2$ + $bcc_2$ | $fcc_2$ | 346 ± 8.2 | 355 ± 9.1 | — | <5% | No |
| $[CuNiMn]_{75}Al_{25}$ | $fcc_2$ + $bcc_2$ | $bcc_2$ | 377 ± 2.1 | 373 ± 4.9 | — | <2% | Yes |
| $[CuNiMn]_{70}Al_{30}$ | $fcc_2$ + $bcc_2$ | $bcc_2$ | 355 ± 10.3 | 359 ± 9.5 | — | <2% | Yes |
| $[CuNiMn]_{60}Al_{40}$ | $bcc_2$ + $bcc_3$ | $bcc_3$ | 395 ± 2.7 | 398 ± 16.8 | — | <2% | Yes |

The samples exhibit increasing hardness with increasing aluminium content. However, even the alloy with the lowest aluminium content at 5 at. % exhibited higher hardness than any of the typical brasses listed in Table 1. Furthermore, strength is comparable with the naval brass and C26000, C23000 and C35300 alloys, but ductility is considerably higher for the same comparable strength.

Above 20 at. % aluminium the samples had considerably higher hardness than the brasses in Table 1, but considerably less compressive strain. Samples at and above 25 at. % aluminium exhibited magnetic properties.

Samples with 10 at. % and 20 at. % aluminium have entropy according to Equation 1 of 1.314 R and 1.379 R respectively.

$[Cu, Ni, Mn]_{100-x}Si_x$ Alloy System

Table 3 below lists four samples of Cu, Ni, Mn, Si alloys and some key properties.

TABLE 3

| Alloy Composition | Crystal Structure: As-Cast | Crystal Structure: Heat treated | Hardness (Vickers): As-Cast | Hardness (Vickers): Heat Treated | Magnetic |
|---|---|---|---|---|---|
| $[CuNiMn]_{97.5}Si_{2.5}$ | $fcc_1$ + $bcc_2$ | $fcc_1$ + $bcc_2$ | 193 ± 6.1 | 183 ± 6.5 | Faint |
| $[CuNiMn]_{95}Si_5$ | $fcc_1$ + $bcc_2$ | $fcc_1$ + $bcc_2$ | 293 ± 12.7 | 250 ± 7.1 | Yes |
| $[CuNiMn]_{90}Si_{10}$ | $fcc_1$ + $bcc_2$ | $fcc_1$ + $bcc_2$ | 330 ± 7.8 | 334 ± 14.4 | Yes |
| $[CuNiMn]_{85}Si_{15}$ | $fcc_1$ + $bcc_2$ | $fcc_1$ + $bcc_2$ | — | 376 ± 10.4 | Yes |

As with the quaternary system including aluminium, the quaternary system including silicon has higher hardness than the typical brasses listed in Table 1. However, faint magnetism exists with even small amounts of silicon.

$[Cu, Ni, Mn]_{100-x}Sn_x$ Alloy System

Table 4 below lists four samples of Cu, Ni, Mn, Sn alloys and some key properties.

TABLE 4

| Alloy Composition | Crystal Structure | | Hardness (Vickers) | | Yield | | |
|---|---|---|---|---|---|---|---|
| | As-Cast | Heat treated | As-Cast | Heat Treated | σC (MPa) | Comp Strain | Magnetic |
| $[CuNiMn]_{95}Sn_5$ | $fcc_1$ + $bcc_2$ | $fcc_1$ + $bcc_2$ | 205 ± 7.6 | 178 ± 5.8 | 420 | 60% | Faint |
| $[CuNiMn]_{90}Sn_{10}$ | $fcc_1$ + $bcc_2$ | $fcc_1$ + $bcc_2$ | 318 ± 4.2 | 255 ± 16.4 | 760 | 20% | Yes |
| $[CuNiMn]_{80}Sn_{20}$ | fcc + $bcc_2$ | $fcc_1$ + $bcc_2$ | 402 ± 1.9 | 533 ± 15.4 | brittle | | Yes |
| $[CuNiMn]_{75}Sn_{25}$ | $bcc_1$ + $bcc_2$ | $bcc_2$ | 467 ± 19.7 | 507 ± 37.0 | brittle | | Yes |

Results for the quaternary alloy system including tin exhibits considerably higher hardness and strength compared to the typical brass alloys listed in Table 1. Relatively small amounts of tin cause the quaternary alloy system to exhibit magnetism.

The samples including at least 20 at. % tin had hardness in excess of 400 Hv in the as-cast from and, even then, responded well to the heat treatment with the result that hardness for both samples increased to well above 500 Hv.

$[Cu, Ni, Mn]_{100-x}Zn_x$ Alloy System

Table 5 below lists four samples of Cu, Ni, Mn, Zn alloys and some key properties.

TABLE 5

| Alloy Composition | Crystal Structure | | Hardness (Vickers) | | Yield | | |
|---|---|---|---|---|---|---|---|
| | As-Cast | Heat treated | As-Cast | Heat Treated | σC (MPa) | Comp Strain | Magnetic |
| $[CuNiMn]_{80}Zn_{20}$ | $fcc_1$ | $fcc_1$ | 109 ± 7.1 | 113 ± 2.8 | 140 | 80% | No |
| $[CuNiMn]_{75}Zn_{25}$ | $fcc_1$ | $fcc_1$ | 147 ± 5.9 | 108 ± 9.7 | 225 | 55% | No |
| $[CuNiMn]_{70}Zn_{30}$ | $fcc_1$ | $fcc_1$ | 118 ± 7.4 | 122 ± 4.4 | — | | No |
| $[CuNiMn]_{65}Zn_{35}$ | $fcc_1$ + $bcc_2$ | $fcc_1$ + $bcc_2$ | 246 ± 7.1 | 248 ± 20 | — | | No |

The zinc-based quaternary alloys did not exhibit magnetic properties and, below 35 at. % zinc, the alloys exhibited relatively low hardness compared to other quaternary alloy samples. However, the samples with relatively low zinc (i.e. 20 at. % and 25 at. % zinc) exhibited relatively high ductility.

$[Cu, Ni, Mn]_{100-x}[Al, Sn, Zn]_x$ Alloy System

Table 6 below lists five samples, one of which consists of Cu, Ni, Mn, Al, Sn and the remainder consisting of Cu, Ni, Mn, Al, Zn.

TABLE 6

| Alloy Composition | Crystal Structure | | Hardness (Vickers) | | |
|---|---|---|---|---|---|
| | As-Cast | Heat treated | As-Cast | Heat Treated | Magnetic |
| $[CuNiMn]_{90}Al_5Sn_5$ | $fcc_1$ + $bcc_2$ | $fcc_1$ + $bcc_2$ | 297 ± 4.4 | 303 ± 9.4 | Yes |
| $[CuNiMn]_{75}Al_5Zn_{20}$ | $fcc_1$ + $fcc_2$ | $fcc_1$ + $fcc_2$ | 250 ± 10.8 | 271 ± 8.8 | No |
| $[CuNiMn]_{60}Al_5Zn_{35}$ | $fcc_1$ + $bcc_1$ | $fcc_1$ + $bcc_1$ | 295 ± 8.5 | — | No |
| $[CuNiMn]_{80}Al_{10}Zn_{10}$ | $fcc_1$ + $bcc_1$ | $fcc_1$ ± $fcc_2$ | 256 ± 12.8 | — | No |
| $[CuNiMn]_{70}Al_{10}Zn_{20}$ | $fcc_1$ + $bcc_2$ | $fcc_1$ + $bcc_2$ | 214 ± 14.4 | — | No |

The hardness for all quinary samples is considerably greater than the hardness of the typical brasses listed in Table 1. As with both the tin- and zinc-based quaternary alloys disclosed in Tables 4 and 5, the quinary alloy sample including tin exhibits magnetic properties, but the quinary alloys including zinc do not. Although aluminium can cause magnetic properties in the alloys, there is insufficient aluminium in the quinary alloys to cause magnetic properties.

To give these alloys context in terms of entropy, the sample consisting of $[CuNiMn]_{80}Al_{10}Zn_{10}$ has entropy of 1.518 R when calculated according to Equation 1.

Although the alloys disclosed in Tables 2 to 6 are based on a master alloy comprising Cu, Ni and Mn in substantially equi-atomic amounts, the invention is not limited to equi-atomic amounts of Cu, Mn and Ni. It is contemplated that the relative amounts of Cu, Ni and Mn in a given alloy will be selected depending on the properties required for the designated application of that alloy. The following description addresses some applications and how the alloy composition might be adjusted to produce the desired properties for that application.

Alloy Variants by Application

The above examples are a subset of the full range of potential HEBs that can be usefully applied by adjusting the alloy composition to produce desired properties. Examples of the different application and how the composition would be adjusted are outlined below.

Reduced Cost Alloys

Based on 5-year market prices, nickel is more expensive than copper (around 1½ times the price) and manganese is essentially ⅓ the price of copper on a per kilogram basis. Given that the HEBs involve replacing a significant quantity of copper in brasses and bronzes with nickel and manganese, savings in terms of raw materials cost are expected to be 5 to 10% and higher if less nickel is used in the alloy. For example, an alloy with a lower Ni and higher Mn content would be considerably cheaper to produce and display similar strengths to the equal ratio alloy (i.e. Cu, Ni and Mn in equal atomic amounts), but may work harden faster and will likely be less corrosion resistant.

Corrosion Resistant

On the other hand, an alloy with a higher Ni content would exhibit superior corrosion resistance. Alloys that contained Al were found to be particularly corrosion resistant. These would be suited to conditions where high corrosion resistance is imperative (although the typical brasses already exhibit good corrosion resistance, it is anticipated that the higher nickel content will result in HEBs have even better corrosion resistance)—say for marine applications.

Anti-Bacterial

It is anticipated that these alloys would have similar 'anti-microbial' properties to conventional brasses. Copper is known to be highly antimicrobial in a range of environments—this is why door knobs and marine components are typically brasses—microbes/barnacles simply don't grow on them. Nickel is also known to be anti-microbial, but is slightly more toxic than copper. Essentially, higher copper and nickel content is preferred for these anti-microbial/anti fouling type alloys.

High Formability Applications

Similar to regular brasses, with small additions of Al, Sn and Zn these alloys only contain the soft and ductile 'alpha' phase in the annealed state. As more Al, Sn or Zn are added these alloys begin to precipitate the much harder and less ductile 'beta' phase. When Al<4 at. % or Sn<4 at. % or Zn<30 at. % there is no beta phase present and these alloys are lower strength, but highly ductile. These alloys would be best suited to forming applications, similar to say munitions brasses (spinning/forming of bullet cartridges) or musical instruments or tubing where the metal is drawn and formed extensively.

High Wear Resistance and Low Friction Applications

When 5<Al<20 or 4<Sn<10 or 30<Zn<40 (at. %), these alloys exhibit a duplex microstructure, which is considerably stronger and harder than alpha phase only alloys, but still quite tough. These alloys would be best suited to the high wear/low friction applications such as keys, hinges, gears/cogs, zippers, door latches. With higher Zn and Al additions, these alloys are also slightly lighter (lower density) and considerably cheaper to produce than regular brasses.

Light Weight

The HEB alloys would not necessarily be considered as 'light weight' when compared with titanium or aluminium alloys for weight savings alone. However, they are always 'lighter' than typical brasses (which are quite heavy) simply due to the presence of Mn and Ni (which is still an advantage). The densities of HEB are still generally comparable to steel.

However, for items that require specific strengths to function with dimensions that can be altered based on this requirement, further materials savings can be made. Specifically, the HEBs exhibit strengths 10-30% higher than that of brasses or bronzes with similar copper-to-zinc or copper-to-aluminium contents and, therefore, less material is required to give the same product strength. It follows that total materials cost savings from 19 to 47% are realistic for a given application.

Low Temperature Fracture Toughness

Traditional steel bolts are bcc and bcc microstructures exhibit a temperature dependent ductile to brittle transition. It is for this reason that cooling steel/bcc metals to a low temperature can result in them shattering or cracking easily under load. With Al<4at % or Sn<4at % or Zn<30at. % these alloys are fcc, hence do not display this ductile to brittle behaviour at low temperatures. Even with a small amount of the bcc phase, these alloys are expected to be ductile at low temperatures.

Non-Sparking

Steel, stainless steel, titanium and magnesium all give off sparks when ground with abrasives. This is not suitable for some environments, particularly where volatiles/flammables are present. Similar to regular brasses and bronzes, the HEB alloys do not spark when ground.

Non-Marking/Staining (Fingerprints)

When polished, the HEB alloys seem to not stain or fingerprint in the same way stainless steel does (for example, brushed metal finish fridges and household appliances are quite prone to permanent staining due to reactions with iron). This is likely due to the oxidising potential of copper (metallic copper is more stable). An HEB with higher Cu, Ni content and containing Al (e.g. $[Cu,Mn,Ni]_{85-99}Al_{1-15}$) is less susceptible to marking in the same ways as stainless steel.

Magnetism

Some of these alloys exhibit strong ferromagnetic properties. This is due to the presence of Mn in combination with Al, Sn or Si in a magnetically ordered bcc phase. As Al, Sn and Si content increases the volume fraction of the magnetic phase increases, and so does the magnetic strength of the alloys. The composition range is quite specific. For quaternary alloys, the ranges are: $[Cu,Mn,Ni]_{70-80}Al_{20-30}$, $[Cu,Mn,Ni]_{70-95}Sn_{5-30}$, $[Cu,Mn,Ni]_{70-97.55}Si_{2.5-30}$. Based on this ordered bcc phase, the optimum quantity of Mn and (Al or Sn) is 25 at. %, e.g. $[Cu,Ni]_{50}Mn_{25}[Al\ or\ Sn]_{25}$. The optimum range for Si is 15-25 at. %, e.g. $[Cu,Ni]_{50-60}Mn_{25}Si_{15-25}$. These alloys are quite brittle and conventional powder consolidation methods would be required to create permanent magnets.

Tin containing alloys show the highest magnetic response. Zinc quaternary alloys are non-magnetic. Also, quinary alloys show magnetism. Any combination of Sn and Al within this composition range, e.g. $[Cu,Mn,Ni]_{70-95}[Al,Sn]_{5-30}$, will be magnetic. Quinary alloys of Cu, Ni and Mn and including Zn and Al show faint magnetism. However, quinary alloys of Cu, Ni and Mn and including Zn and Sn exhibit moderate magnetism. This is due to Sn causing strongly magnetic behaviour in alloys with relatively small amounts of Sn, e.g. more than 5 at. %. For the same reason, it is expected that alloys of Cu, Mn, Ni, Al, Zn and Sn will be magnetic due to the presence of an ordered bcc phase.

Processing and Machinability

The HEB alloys may be processed in the same way as current brasses with no modification to existing processing technology, with similar melting and casting properties to conventional brasses and similar post production working/machining properties.

Specifically, the addition of small amounts of Pb will improve machinability. It is understood that Pb is immiscible with regular brass and, therefore, forms a fine dispersion within the brass which improves machinability of the bulk brass. It is expected that similar additions of Pb in the HEBs will have a similar effect.

This includes processes for application of coatings. To be more specific, many brass-based products are plated with harder, more corrosion resistant or more aesthetically pleasing coatings such as chrome, nickel, silver or even gold. The electrochemical properties allowing easy plating for these new high entropy brasses remains unchanged compared to traditional brasses, hence these commercial treatments are still completely compatible.

Recyclability

There already exists a world-wide brass recycling industry and due to the corrosion resistance and relatively lower melting point of brass—this is more economically viable and efficient than recycling steels. These HEB alloys are no exception, and in-fact could be reliably manufactured in-part by recycled traditional brasses, reducing cost further per recycling iteration.

In the claims which follow, and in the preceding description, except where the context requires otherwise due to express language or necessary implication, the word "comprise" and variations such as "comprises" or "comprising" are used in an inclusive sense, i.e. to specify the presence of the stated features but not to preclude the presence or addition of further features in various embodiments of the apparatus and method as disclosed herein.

The invention claimed is:

1. An alloy consisting of:

| | |
|---|---|
| Copper | 17 to 50 at. % |
| Nickel | 17 to 50 at. % |

-continued

| | |
|---|---|
| Manganese | 17 to 50 at. % |
| Zinc | 20 to 35 at. % |
| Chromium | 0 to 2 at. % |
| Iron | 0 to 2 at. % |
| Cobalt | 0 to 2 at. % |
| Lead | 0 to 2 at. % |

and wherein the alloy has entropy of mixing ($\Delta S_{mix}$) of at least 1.1 R when calculated according to:

$$\Delta S_{mix} = -R\sum_{i=1}^{n}(c_i \text{ in } c_i) \quad \text{(Equation 1)}$$

where c is the molar percentage of the ith component and R is the gas constant, and wherein the copper, nickel and manganese are present in substantially equal atomic percentages.

2. The alloy defined in claim 1, wherein the alloy has entropy in the range of 1.1 R to 2.5 R.

3. The alloy defined in claim 1, wherein the alloy has entropy in the range of 1.3 R to 2.OR.

4. The alloy defined in claim 1, wherein the alloy consists of Cu, Mn, Ni and Zn and has an as-cast hardness ($H_v$) in the range of 102 to 253.

5. The alloy defined in claim 1, wherein the alloy has compressive yield strength in the range of 140 to 760 M Pa.

6. The alloy defined in claim 1, wherein the alloy has strain at compressive failure of 2% to 80%.

* * * * *